US007240685B2

(12) United States Patent
Seo

(10) Patent No.: US 7,240,685 B2
(45) Date of Patent: Jul. 10, 2007

(54) SIDE RAIL ASSEMBLY FOR A CANOPY INCLUDING A SIDE RAIL HAVING A HOOK FOR ENGAGING A SIDE RAIL CONNECTOR ON AN UPRIGHT OF THE CANOPY

(75) Inventor: Dong Woog Seo, Taegu (KR)

(73) Assignee: Caravan Canopy International, Inc., Compton, CA (US)

( * ) Notice: Subject to any disclaimer, the term of this patent is extended or adjusted under 35 U.S.C. 154(b) by 240 days.

(21) Appl. No.: 10/758,762

(22) Filed: Jan. 15, 2004

(65) Prior Publication Data

US 2004/0182430 A1 Sep. 23, 2004

(30) Foreign Application Priority Data

Jan. 17, 2003 (KR) ..... 20-2003-0001544

(51) Int. Cl.
*E04H 15/32* (2006.01)

(52) U.S. Cl. ..... 135/120.3

(58) Field of Classification Search ..... 135/131, 135/140–144, 120.3, 909; 52/641, 645, 646; 248/219.3, 230.1; 403/170, 175, 230, 217, 403/218, 23, 234, 231

See application file for complete search history.

(56) References Cited

U.S. PATENT DOCUMENTS 744,194 A * 11/1903 Harrison ..... 52/651.1
1,808,082 A * 6/1931 Thompson ..... 52/637
2,001,215 A * 5/1935 Ruppel ..... 403/170
2,897,013 A * 7/1959 Delp ..... 52/645
3,133,549 A 5/1964 Severing
4,066,089 A * 1/1978 Rainwater ..... 135/151
4,703,769 A * 11/1987 Harrison, Jr. ..... 135/67
4,864,795 A * 9/1989 Burg ..... 52/646
5,024,251 A * 6/1991 Chapman ..... 16/361
5,056,291 A * 10/1991 Leung ..... 52/637
5,094,562 A * 3/1992 Anderson ..... 403/170
5,215,108 A * 6/1993 Sprague ..... 135/90
5,244,001 A * 9/1993 Lynch ..... 135/145
5,634,619 A * 6/1997 Alessi ..... 248/219.3
5,701,923 A * 12/1997 Losi et al. ..... 135/131
5,794,640 A * 8/1998 Jang ..... 135/131
5,944,040 A * 8/1999 Jang ..... 135/126
6,041,800 A * 3/2000 Carter ..... 135/145
6,152,157 A * 11/2000 Jang ..... 135/131
6,478,039 B2 * 11/2002 Suh ..... 135/120.3
6,553,698 B1 * 4/2003 Kemeny ..... 40/610
6,758,354 B2 * 7/2004 Carletti ..... 211/189
2002/0134417 A1 9/2002 Suh

FOREIGN PATENT DOCUMENTS

GB 2167479 A * 5/1986

* cited by examiner

*Primary Examiner*—Tamara L. Graysay
(74) *Attorney, Agent, or Firm*—Christie, Parker & Hale, LLP

(57) ABSTRACT

A side rail assembly for a canopy having a plurality of uprights is provided that includes a side rail having a first end and a second end with a hook attached to the first end of the side rail; and a mounting bracket mounted on a corresponding one of the uprights. The mounting bracket includes a first side rail connector having a post, such that the hook engages the post to secure the side rail to the mounting bracket.

32 Claims, 12 Drawing Sheets

FIG. 7
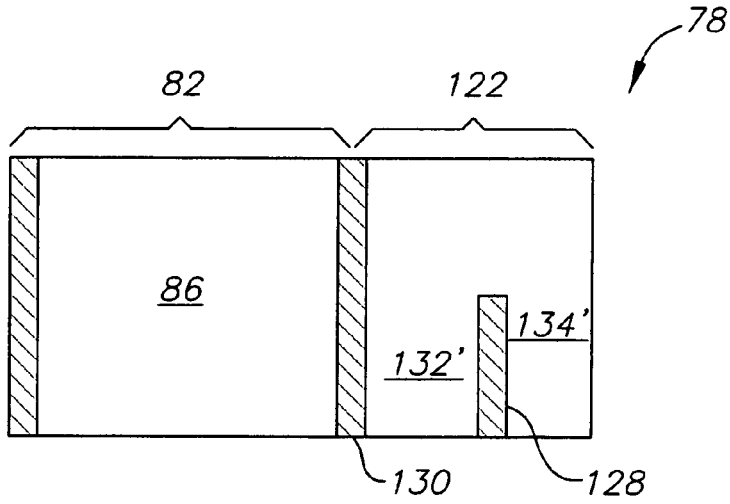
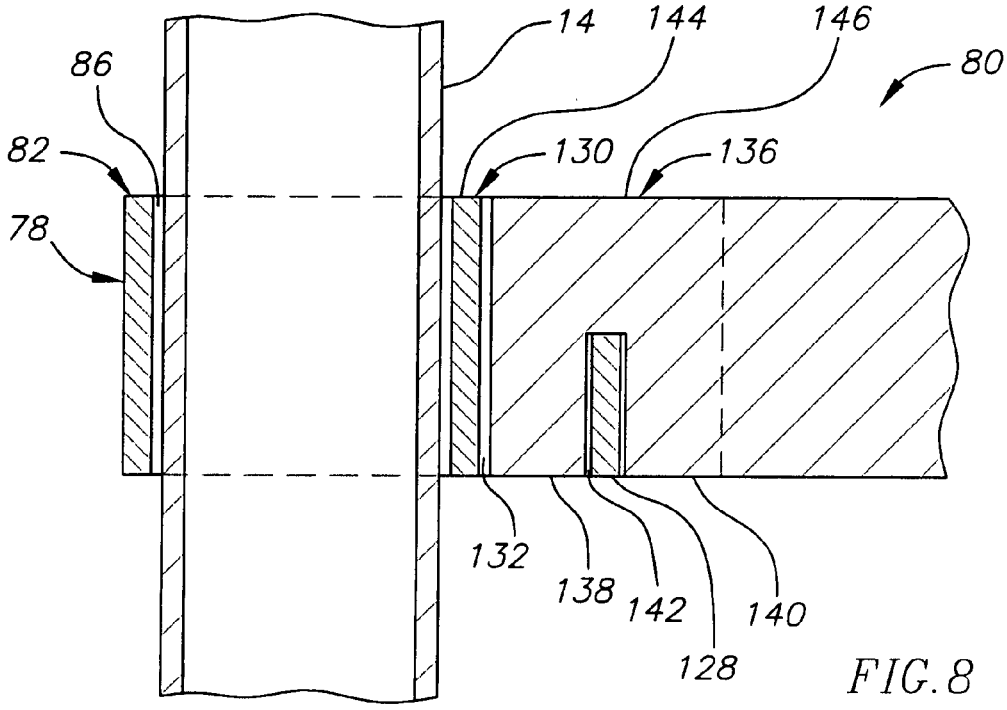
FIG. 8

SIDE RAIL ASSEMBLY FOR A CANOPY INCLUDING A SIDE RAIL HAVING A HOOK FOR ENGAGING A SIDE RAIL CONNECTOR ON AN UPRIGHT OF THE CANOPY

CROSS-REFERENCE TO RELATED APPLICATION(S)

This application claims priority to and the benefit of Korean Utility Model Application No. 2003-0001544 filed on Jan. 17, 2003 in the Korean Intellectual Property Office, now registered as Utility Model Registration No. 0312123 on Apr. 21, 2003, the entire contents of which are incorporated herein by reference.

FIELD OF THE INVENTION

The present invention relates to collapsible canopy frames, and more particularly to a collapsible canopy frame having at least one side rail assembly as a support structure.

BACKGROUND

Canopy frames include a plurality of uprights, typically disposed about the periphery of the frame. A canopy covering, such as a cloth or leather covering, is disposed above and supported by the canopy frame. It is know to attach side rails to adjacent uprights to provide lateral stability therebetween.

However, conventional side rails can be difficult to install and complicated in structure. In addition, despite their complicated structures, conventional side rails can be flimsy and without a great deal of stability. In particular, conventional side rails can fracture in the event of torsional stresses caused, for example, when one or more of the uprights of the canopy frame shifts or otherwise moves relative to the remaining uprights. Also, complicated means can be required in order to fix the side rail at a desired height on a corresponding one of the uprights and/or to prevent relative movement between the side rail and the upright to which it is attached. Accordingly, a need exists for an improved side rail assembly and/or components related thereto for attachment to a canopy frame.

SUMMARY

In an exemplary embodiment according to the present invention, a side rail assembly for a canopy having a plurality of uprights is provided that includes a side rail having a first end and a second end with a hook attached to the first end of the side rail; and a mounting bracket mounted on a corresponding one of the uprights. The mounting bracket includes a first side rail connector having a post, such that the hook engages the post to secure the side rail to the mounting bracket.

In another exemplary embodiment of the present application, a side rail assembly for a canopy having a plurality of uprights is provides that includes a side rail having a first end and a second end, with a hook attached to the first end of the side rail. The side rail assembly also includes a mounting bracket mounted on a corresponding one of the uprights. The mounting bracket includes a body and a cover pivotally connected to the body. The body and the cover together define an opening that receives the corresponding one of the uprights. The cover pivots between an open position and a closed position, such that in the open position the mounting bracket is insertable around the corresponding one of the uprights and in the closed position the mounting bracket is frictionally secured to a side surface of the corresponding one of the uprights. The side rail assembly also includes a first side rail connector having a post, wherein the hook engages the post to secure the side rail to the mounting bracket.

In yet another exemplary embodiment of the present invention, a collapsible canopy frame is provided that includes telescoping uprights and a set of edge scissor assemblies that are pivotally coupled between adjacent ones of the telescoping uprights. Each set of edge scissor assemblies includes ribs that rotate relative to each other. The collapsible canopy frame also includes a side rail having a first end and a second end, with a hook attached to the first end of the side rail; and a mounting bracket mounted on a corresponding one of the uprights. The mounting bracket includes a first side rail connector having a post. The hook engages the post to secure the side rail to the mounting bracket.

These and other aspects of the invention will be more readily comprehended in view of the discussion herein and accompanying drawings, in which like reference numerals designate like elements.

BRIEF DESCRIPTION OF THE DRAWINGS

FIG. 7 is a cross-sectional view of a mounting bracket of the side rail assembly of FIG. 5 taken along line 7—7 of FIG. 5;

FIG. 8 shows the cross-sectional of the mounting bracket of FIG. 7, with an upright disposed within a cavity of the mounting bracket and a side rail mounted to a side rail connector of the mounting bracket;

DETAILED DESCRIPTION

As shown in FIGS. 1–16, the present invention is directed to a side rail assembly for a canopy frame, and more particularly to a side rail assembly for a collapsible canopy frame.

Figure 1:
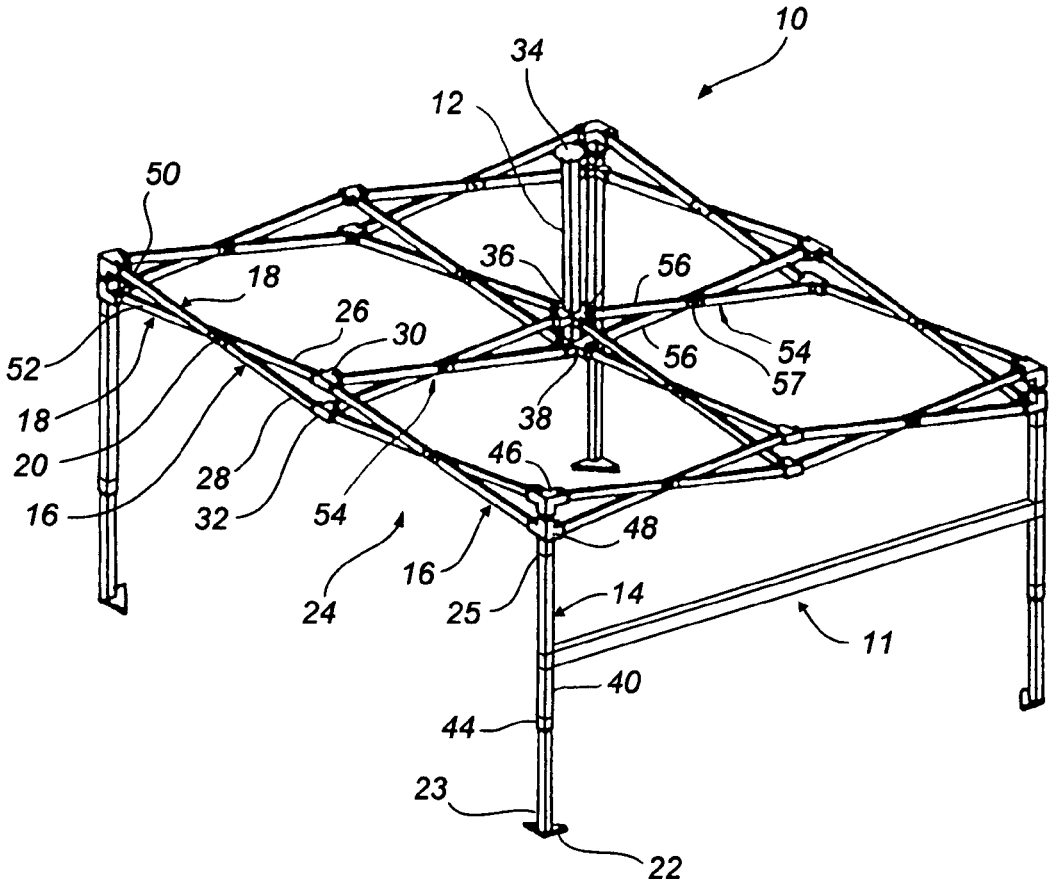
FIG. 1 is a perspective view of a canopy frame having a side rail assembly according to an exemplary embodiment of the present invention.

FIG. 1 illustrates a collapsible canopy frame 10 having a side rail assembly 11 according to an exemplary embodiment of the present invention. As shown, the collapsible canopy frame 10 includes a center support pole 12, a plurality of telescoping uprights 14 and edge scissor assemblies 16 that interconnect each pair of adjacent uprights 14. Each of the edge scissor assemblies 16 are formed of a pair of ribs 18 connected together and rotatable about a pivot 20.

In one embodiment, each telescoping upright 14 has a substantially square cross-section, and a triangular support plate 22 attached at a bottom end 23 thereof for supporting the weight of the collapsible canopy frame 10. In FIG. 1, the collapsible canopy frame 10 has four telescoping uprights 14 arranged in a generally rectangular or square configuration. In other embodiments, however, collapsible canopy frames may have any appropriate number of telescoping uprights 14 arranged in any appropriate configuration, such as hexagonal or octagonal, among other appropriate configurations. In one embodiment, each pair of adjacent uprights 14 are interconnected to each other through a set 24 of two edge scissor assemblies 16 attached at a top end 25 of the adjacent uprights 14. The set 24 of edge scissor assemblies 16 are pivotally coupled to the respective uprights 14 and to each other. Upper and lower inner ends 26 and 28 of each edge scissor assembly 16 are pivotally coupled to the upper and lower inner ends of the other edge scissor assembly 16 of the same set 24 via upper and lower connecting brackets 30 and 32, respectively.

Attached to the center support pole 12 is a head member 34, such as a convex shaped head member, which supports a canopy cover (not shown) at the center of the canopy frame. An upper central hub 36 and a lower central hub 38 are also mounted on the center support pole 12. The upper central hub 36 is slidable with respect to the center support pole 12, while the lower central hub 38 is substantially stationary with respect to the center support pole 12.

Each telescoping upright 14 includes two telescoping sections 40 and 42, which correspond to upper and lower sections, respectively. The upper and lower sections 40 and 42 are fixed to each other with a height adjustment bracket 44, which adjusts the relative positions of the upper and lower sections 40 and 42 and therefore the height of each telescoping upright 14. In other exemplary embodiments, the uprights 14 are not telescoping, and instead have a fixed length.

Each telescoping upright 14 has a stationary bracket 46 and a sliding bracket 48 mounted thereon. At each corner of the canopy frame 10, outer upper ends 50 of the edge scissor assemblies 16 are pivotally coupled to the corresponding stationary bracket 46. In addition, lower outer ends 52 of the edge scissor assemblies 16 are pivotally coupled to the sliding bracket 48.

The canopy frame 10 also includes center scissor assemblies 54. Each of the center scissor assemblies 54 is pivotally coupled between the center support pole 12 and a corresponding set 24 of the edge scissor assemblies 16. In more detail, each center scissor assembly 54 is pivotally coupled between the upper and lower connecting brackets 30 and 32 of the edge scissor assemblies 16 and the upper and lower central hubs 36 and 38 of the center support pole 12. Each center scissor assembly 54 is formed by pivotally coupling a pair of ribs 56 about their respective centers 57. In one embodiment, the center scissor assembly 54 has substantially the same structure as the edge scissor assembly 16.

Figure 2:
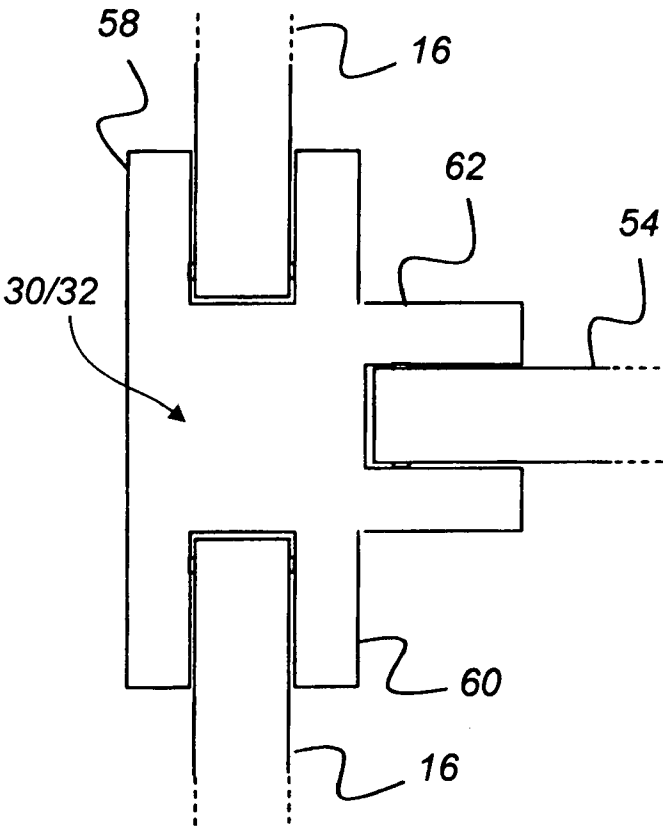
FIG. 2 is a cross-sectional view of a connecting bracket between adjacent edge scissor assemblies of the collapsible canopy frame of FIG. 1.

Referring now to FIGS. 1 and 2, each of the upper and lower connecting brackets 30 and 32 has three connecting members 58, 60 and 62. The connecting members 58 and 60 face at substantially 180 degrees of each other, and are used to pivotally couple the edge scissor assemblies 16 of the same set 24 to each other. The connecting member 62 faces at substantially a right angle with respect to each of the two 180-degree apart connecting members, and is used to pivotally couple the center scissor assembly 54 to the edge scissor assemblies 16.

Figure 3:
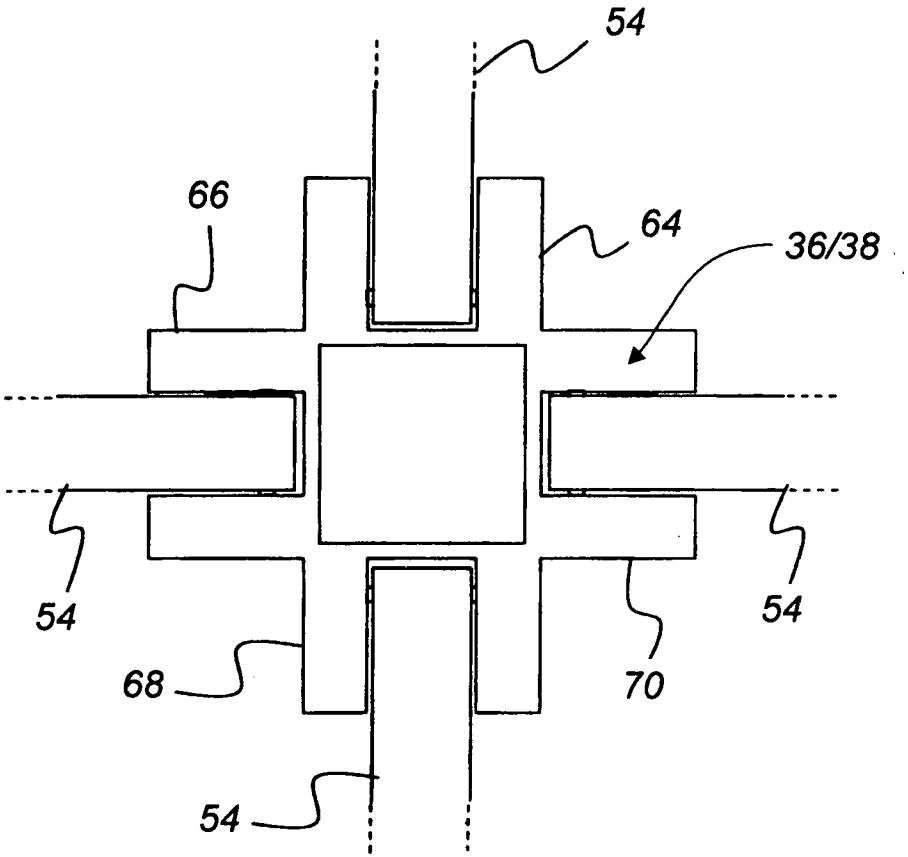
FIG. 3 is a cross-sectional view of a central hub mounted on a center support pole of the collapsible canopy frame of FIG. 1.

Referring now to FIGS. 1 and 3, each of the upper and lower central hubs 36 and 38 has four connecting members 64, 66, 68, and 70, each facing one set 24 of edge scissor assemblies 16. The upper and lower central hubs 36 and 38 are pivotally connected to four different center scissor assemblies 54 that extend at approximately 90-degrees apart from one another. Hence, each center scissor assembly 54 is pivotally coupled between the center support pole 12 and a corresponding set 24 of the edge scissor assemblies 16.

Figure 4:
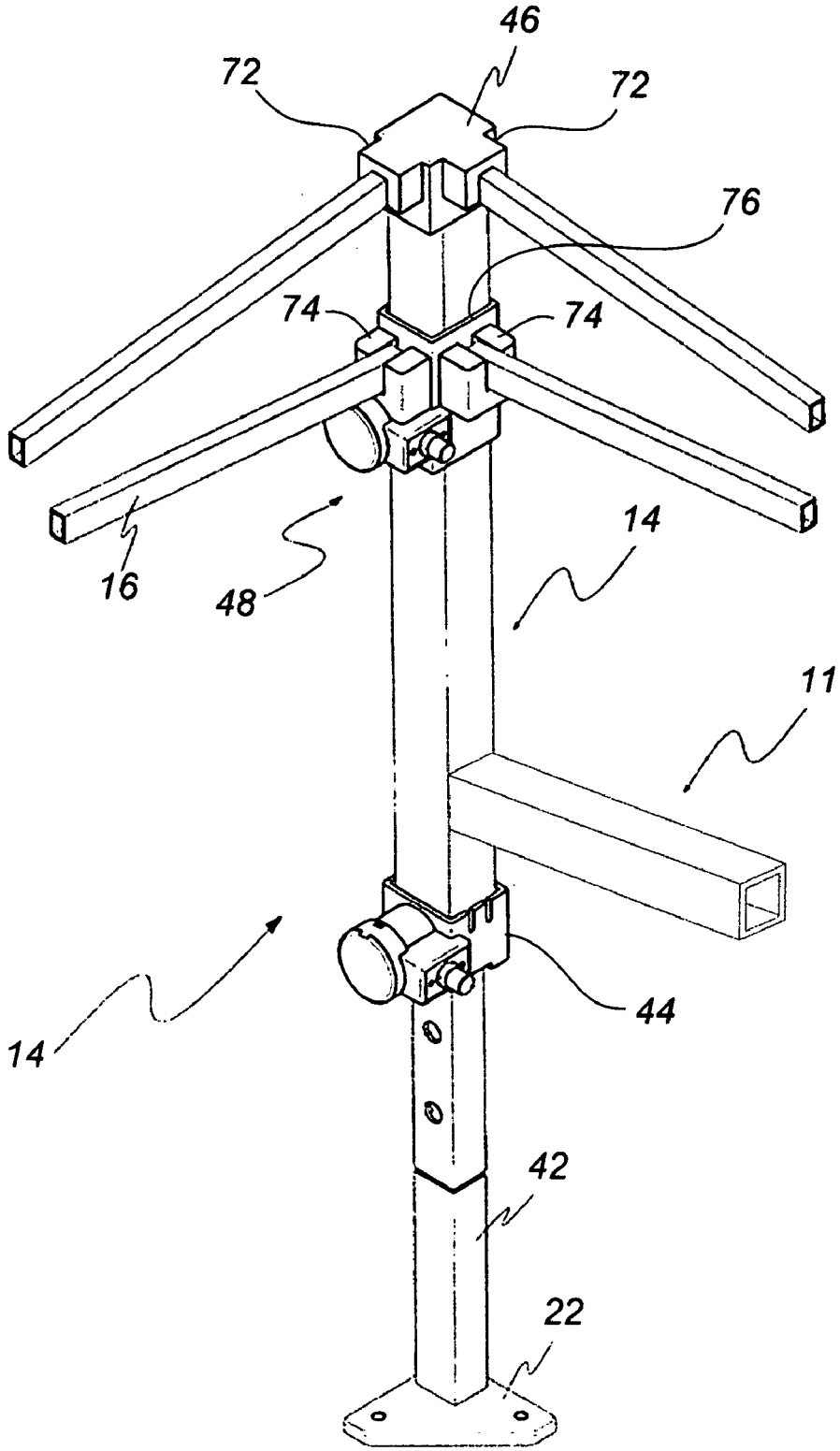
FIG. 4 is a perspective view of a telescoping upright of the canopy frame of FIG. 1.

FIG. 4 is a detailed view of one of the uprights 14 of the collapsible canopy frame 10. The stationary mounting bracket 46 has two connecting members 72 that face at substantially a right angle to each other for pivotally coupling with the corresponding edge scissor assemblies 16. Similarly, the sliding mounting bracket 48 has two connecting members 74 facing at substantially a right angle to each other for pivotally coupling with the corresponding edge scissor assemblies 16. The sliding mounting bracket 48 has an opening 76 therethrough for slidably coupling with the upper section 40 of the upright 14. The opening 76 has a substantially square cross sectional shape to receive in close but slidably fitting relation, the upper section 40, which has a corresponding substantially square cross sectional shape.

FIGS. 1 and 4 illustrate the collapsible canopy frame 10 and each upright 14 in a fully opened position, in which the ribs 18 and 56 are in a generally horizontal orientation. As the collapsible canopy frame 10 is being collapsed, the angle between the scissor assemblies and the connecting members 72 and 74 decreases, and the distance between adjacent uprights 14 decreases. Meanwhile, the sliding mounting bracket 48 slides along the upper section 40 in a downward direction towards the height adjustment bracket 44 and away from the stationary mounting bracket 46.

Figure 5:
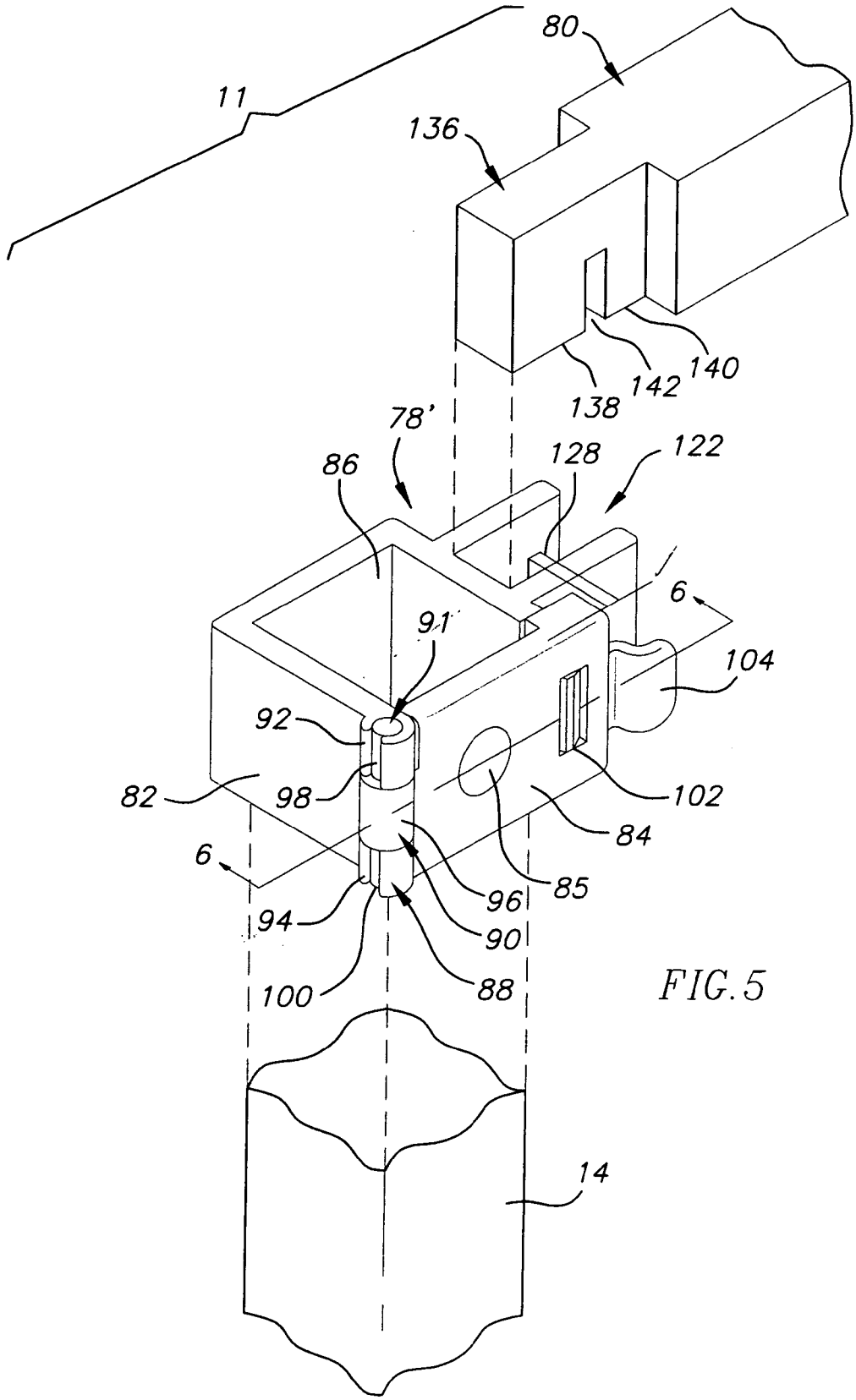
FIG. 5 is an exploded perspective view of a side rail assembly according to an exemplary embodiment of the present invention detached from an upright.

FIG. 5 is an exploded view of the side rail assembly 11 detached from a corresponding upright 14 of the collapsible canopy frame 10. The side rail assembly 11 includes a mounting bracket 78 and a side rail 80. As described in detail below, the mounting bracket 78 is mounted to a corresponding upright 14 of the collapsible canopy frame 10 and the side rail 80 is mounted to the mounting bracket 78.

Figure 6A:
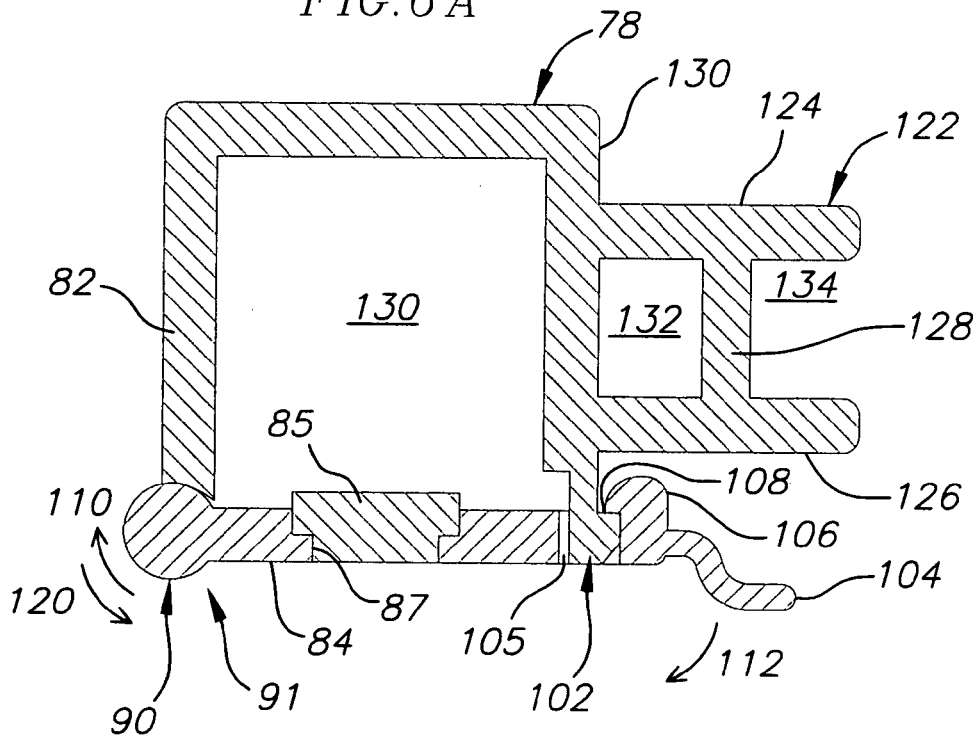
FIG. 6A is a cross-sectional view of a mounting bracket of the side rail assembly of FIG. 5 taken along line 6—6 of FIG. 5.
Figure 6B:
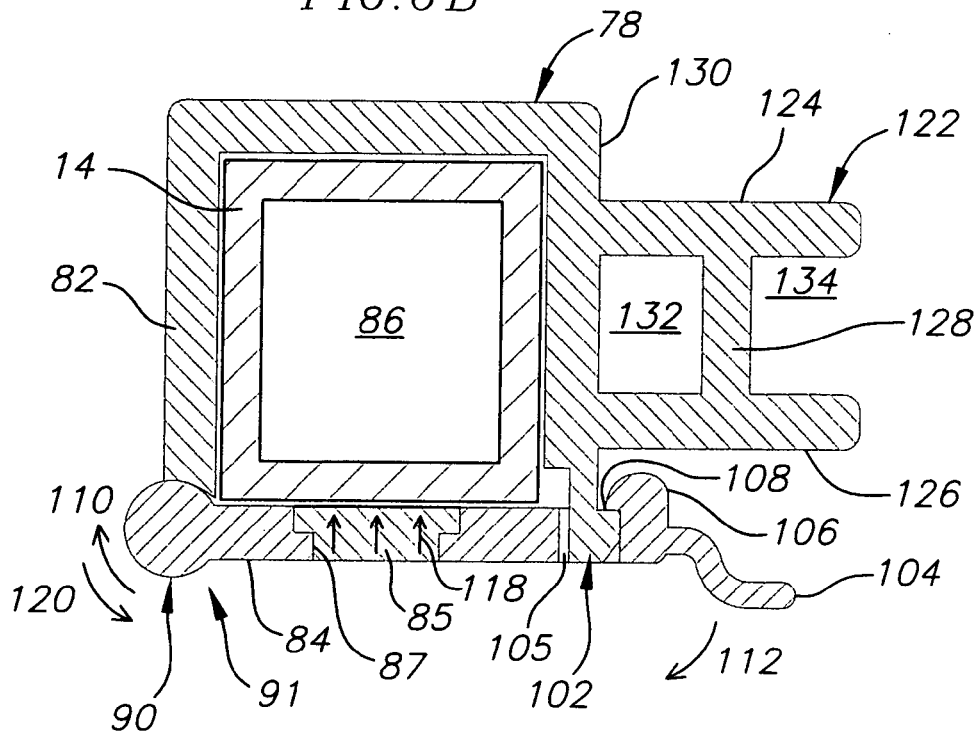
FIG. 6B is a cross-sectional view of a mounting bracket of the side rail assembly of FIG. 5 taken along line 6—6 of FIG. 5 and showing an upright disposed within an opening in the mounting bracket.
Figure 6C:
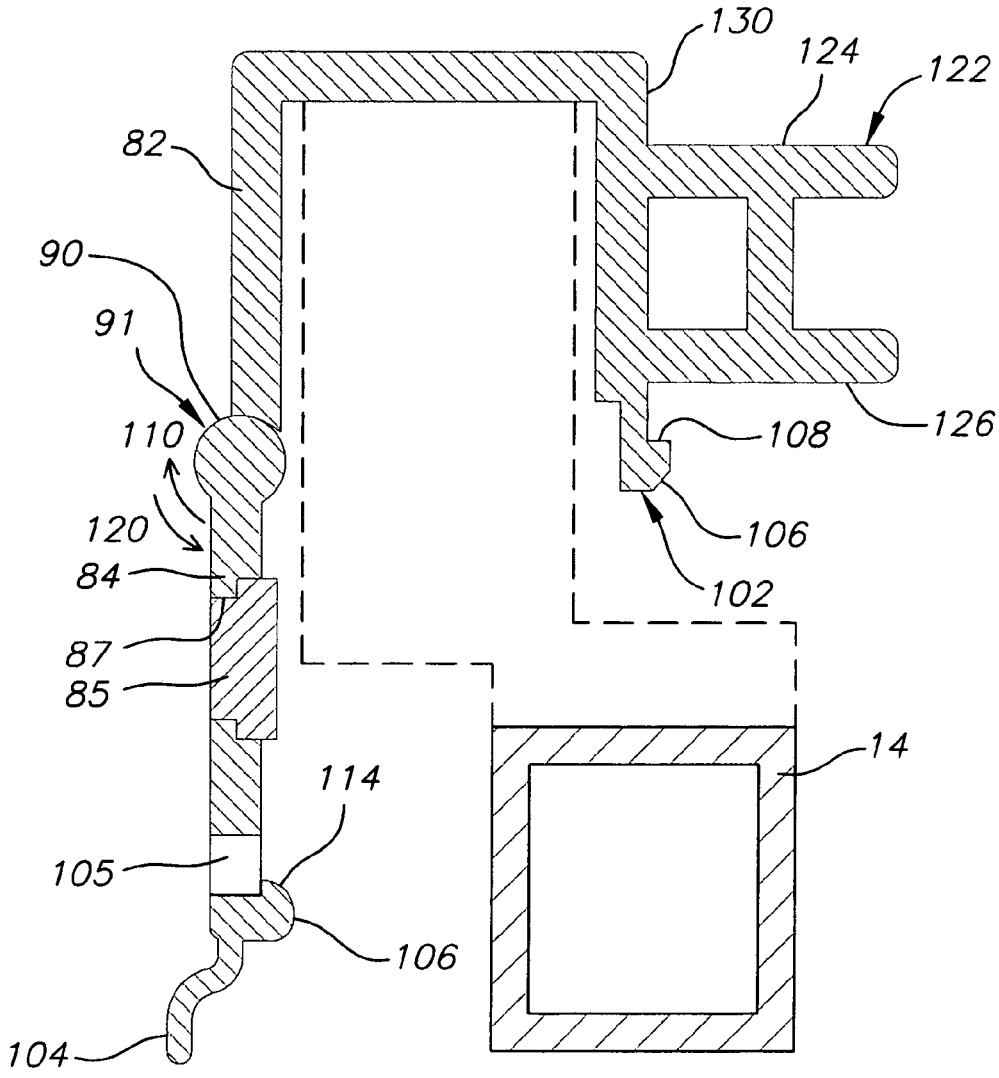
FIG. 6C is a cross-sectional view of a mounting bracket of the side rail assembly of FIG. 5, showing a cover of the mounting bracket in an open position and a detached upright.

Viewing FIGS. 5–6C together, the mounting bracket 78 includes a body 82 and a cover 84. The cover 84 is pivotally mounted to the body 82, such that the cover 84 is moveable between a closed position, shown for example in FIGS. 5–6B, and an open position, shown for example in FIG. 6C. In the closed position, the cover 84 and the body 82 together define a cavity 86 for receiving the upright 14, (see FIGS. 5 and 6A.) In the depicted embodiment, the cavity 86 is generally rectangular shaped and closely matches the shape and size of the outer perimeter of the upright 14. However, in other embodiments the cavity 86 may be of any size and shape that closely match the shape and size of the outer perimeter of the upright 14. The cover 84 includes a resilient compression element 85, composed of a resilient compressible material, such as rubber. The resilient compression element 85 is mounted in an opening 87 of the cover 84, such as by an epoxy, and extends into the generally rectangular shaped cavity 86.

In the depicted embodiment, the body 82 is generally U-shaped. In one embodiment, one end of the U-shaped body 82 includes an arm 88 that receives a pin assembly 90 of the cover 84 to pivotally couple the cover 84 to the body 82. In this embodiment, the arm 88 and the pin assembly 90 combine to form a hinge 91.

As shown, the arm 88 includes spaced apart upper and lower C-shaped sections 92 and 94. Each of the C-shaped sections 92 and 94 includes resilient arms that form the sides of the C-shape. The pin assembly 90 includes a cylindrical section 96 with upper and lower pins 98 and 100 axially extending therefrom. Each pin 98 and 100 is larger than the open end of the C-shaped sections 92 and 94. To attach the pin assembly 90 to the arm 88, the cylindrical section 96 of the pin assembly 90 is disposed in the space between the C-shaped sections 92 and 94 and the pins 98 and 100 are then pressed against the resilient arms of each C-shaped section 92 and 94 to spread apart the resilient arms. When the pins 98 and 100 pass the resilient arms, the resilient arms form around the pins 98 and 100 to pivotally secure the cover 84 to the body 82.

In alternative embodiments, the mounting bracket 78 includes any appropriate structure for pivotally attaching the cover 84 to the body, such as a separate hinge that is independently mounted to each of the cover 84 and the body 82, or an integral hinge that is integrally formed with the cover 84 and the body 82, among other appropriate structures.

At an end of the body 82, opposite from the hinge arm 88 is a protrusion 102 having a shoulder 108. The protrusion 102 extends through an opening 105 in the cover 84. The cover 84 also includes a handle 104 having a detent 106 that lockingly engages the shoulder 108 of the protrusion 102.

FIGS. 5–6B show the cover 84 in a closed position. The cover 84 is pivoted from the closed position to the open position by pivoting the cover 84 about the hinge 91 as shown by arrow 110. In order to pivot the cover 84 about the hinge 91, the handle 104 is pivoted as shown by arrow 112. Such a pivoting of the handle 104 causes the detent 106 of the handle 104 to disengage the shoulder 108 of the protrusion 102. With the shoulder 108 of the protrusion 102 disengaged from the detent 106 of the handle 104, the cover 84 is free to rotate about the hinge 91.

In the open position, the body 82 of the mounting bracket 78 can be placed in surrounding relation to the upright 14 as shown in FIG. 6C. The cover 84 is pivoted from the open position to the closed position by pivoting the cover 84 about the hinge 91 in the direction of arrow 120, which is oppositely directed from arrow 110. The cover 84 is lockingly engaged to the body 82 by pressing the handle 104 into contact with the protrusion 102. As shown in FIG. 6C, a ramp 114 on the handle 104 slidably engages a corresponding ramp 116 on the protrusion 102 causing the detent 106 of the handle 104 to bow slightly outwardly. When the handle 104 has been moved past the shoulder 108 of the protrusion 102, the detent 106 of the handle 104 resiliently engages the shoulder 108 of the protrusion 102 to lockingly engage the cover 84 to the body 82.

When the body 82 of the mounting bracket 78 is placed in surrounding relation to the upright 14, and the cover is moved into the closed position as shown in FIG. 6B, the resilient compression element 85 is compressed by a side wall of the upright 14 causing the resilient compression element 85 to apply a corresponding force to the side wall of the upright 14, as shown by arrows 118, to frictionally secure the mounting bracket 78 to the upright 14. As such, the mounting bracket 78 is removably secured to the upright 14. The mounting bracket 78 can by mounted at any desired location along the upright 14, depending on the desired height of the side rail 80 relative to the upright 14. In one embodiment, the body 82 is composed of a polymeric material, such as a plastic material. In such an embodiment, each of the components of the body 82 is optionally integrally formed in an injection molding process. Similarly, In one embodiment, the cover 84 is composed of a polymeric material, such as a plastic material. In such an embodiment, each of the components of the cover 84 is optionally integrally formed in an injection molding process.

As shown in FIG. 5, the side rail 80 has an end that engages a side rail connector 122. Viewing FIGS. 5–6C together, the side rail connector 122 extends from a sidewall 130 of the body 82 of the mounting bracket 78. In the depicted embodiment, the side rail connector 122 is integrally formed with the body 82 and hence is composed of the same material as the body. In an alternate embodiment, the side rail connector 122 is a separate component that is mounted to the body 82.

The side rail connector 122 includes two walls 124 and 126. In the depicted embodiment, the walls 124 and 126 and spaced apart and disposed substantially parallel to each other. A post 128 is disposed between and connected to the walls 124 and 126. The post 128 is spaced apart from the sidewall 130 of the body 82, such that the post 128 and the walls 124 and 126 together define a hook opening 132. The post 128 is also spaced apart from the ends of the walls 124 and 126 that are opposite from the sidewall 130 of the body 82, such that the side rail connector 122 has an open end 134. As such, in one embodiment, the side rail connector 122 is generally H-shaped As shown in FIGS. 5 and 8, an end of the side rail 80 includes a hook 136. The hook 136 includes first and second arms 138 and 140 spaced apart to define a recess 142. To secure the side rail 80 to the side rail connector 122, the arms 138 and 140 are placed in surrounding relation to the post 128. In such a position, the first arm 138 extends into the hook opening 132, the second arm 140 extends into the open end 134 of the side rail connector 122 and the recess 142 receives the post 128. The side rail 80 is removed from the side rail connector 122 by simply lifting the hook 136 off of the post 128. As such, the side rail 80 is easily removably secured to the side rail connector 122.

While the distance between the surfaces of the recess 142 and the post 128 and the distance between the sidewall 130 and the first arm 138 are shown to be not insubstantial for illustrative purposes, in practice, the distances between the surfaces of the hook 136 and the facing surfaces of the side rail connector 122 may be very small such that the adjacent surfaces may actually be touching each other.

As shown in FIG. 8, in one embodiment, the post 128 is downwardly spaced from a top surface 144 of the mounting bracket 78. This allows the top surface 146 of the side rail 80 to be disposed substantially flush with the top surface 144 of the mounting bracket 78 when the hook 136 is engaged with the post 128 of the side rail connector 122. Such an arrangement gives an aesthetically pleasing uniform appearance to the side rail assembly 11 when the side rail 80 is attached to the upright 14 through the mounting bracket 78.

Figure 9:
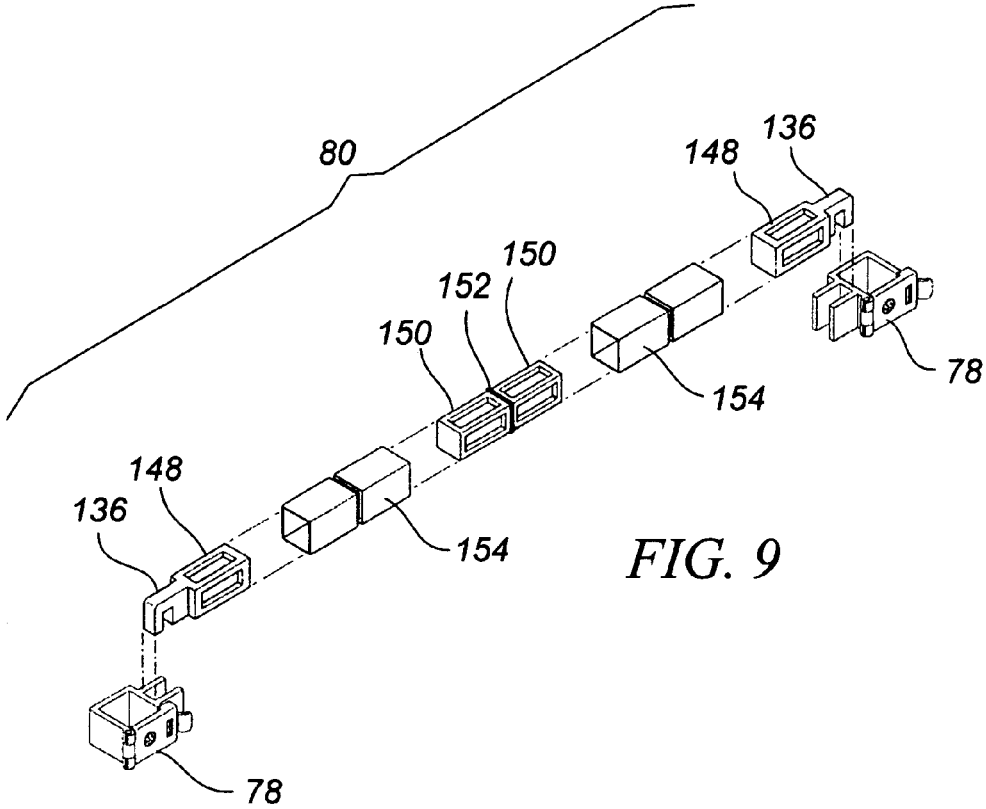
FIG. 9 is an exploded perspective view of a side rail detached from two mounting brackets.

FIG. 9 shows an exploded view of the side rail 80. Each end of the side rail 80 includes the hook 136 for attachment to the mounting bracket 78 as described above. In the depicted embodiment, each hook 136 is connected to a support connector 148, which in turn is coupled to a second support connector 150 via a respective support tube 154. While each support tube 154 appears as two short sections, in practice, each support tube is elongated (e.g. has a length of approximately half the distance between two adjacent uprights 14). The second support connectors 150 are connected via a flange 152, which protrudes from an outer periphery between the second support connectors 150. Each of the support connectors 148 and the second support connectors 150 has a length less than or equal to the length of the support tube 154. In practice, the support connectors have a length which is only a fraction of the length of the support tubes.

The support tube 154 is inserted over the support connector 148, and moved relative thereto until the hook 136 is situated at a first end of the support tube 154. Further, the second support connector is inserted into a second end of the support tube 154 until the second end of the support tube 154 abuts the flange 152, which provides a stopping point for the insertion of the support connector 150 into the support tube 154. In this position, the hook 136 extends from the first end of the support tube 154 opposite from the second end of the support tube 154. This way, the side rail 80 may be disassembled with ease by removing the supporting connectors 148 and 150 from the supporting tubes 154. In other embodiments, the support tubes 154 may be fixedly secured to the flange 152, such as by a fastener or a weld. In one embodiment, the hook 136, the support frames 148 and 150, the flange 152 and the cover tube 154 are each composed of a metal material such as an aluminum material or a stainless steel material.

In an alternate embodiment, the side rail may be formed of a single integrated piece including the hooks at both ends. In other embodiments, the side rail may be formed of multiple tube sections, two of which have an integrally formed hook at one end. At least one of the tube sections has an integrally formed support connector on at least one end, such that the tube sections can be interconnected.

Figure 10:
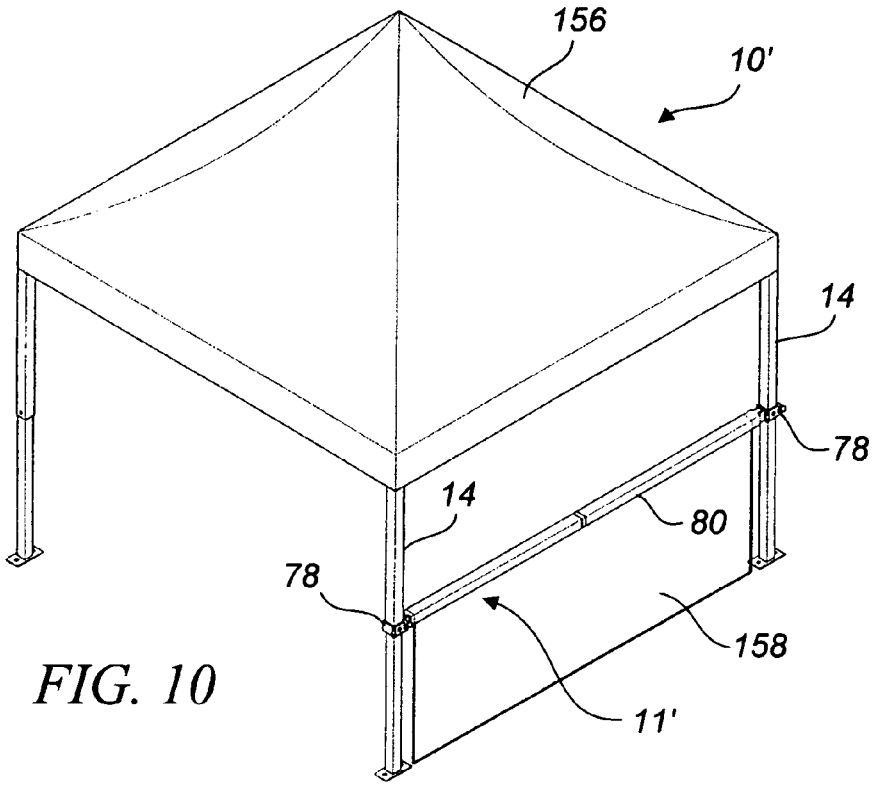
FIG. 10 is a perspective view of a side rail assembly according to another exemplary embodiment of the present invention attached to a collapsible canopy frame.

FIG. 10 shows the side rail assembly 11' attached to a collapsible canopy frame 10' (note in the illustration of FIG. 10, a cover 156 is attached to the collapsible canopy frame 10'.) The side rail assembly 11' includes the side rail 80 and two mounting brackets 78. To secure the side rail assembly 11' to the collapsible canopy frame 10', the mounting brackets 78 are attached to adjacent uprights 14 at a desired height. The side rail 80 is then installed between the adjacent uprights 14 by mounting each end of the side rail 80 to a corresponding one of the mounting brackets 78. Although the side rail assembly 11' is shown attached to a front facing pair adjacent uprights 14, the side rail assembly 11' can be attached between any one or more pairs of adjacent uprights 14. As also shown in FIG. 10, a side panel 158 can be installed on the side rail assembly 11' to cover a lower portion of the area between the adjacent upright 14, such as by removably attaching integrally formed loops of the side panel 158 to the side rail 80. In one embodiment, the side panel 158 is composed of a cloth material. In other embodiments, the side panel may be made of plastic, vinyl, leather or any other suitable material.

Figure 11:
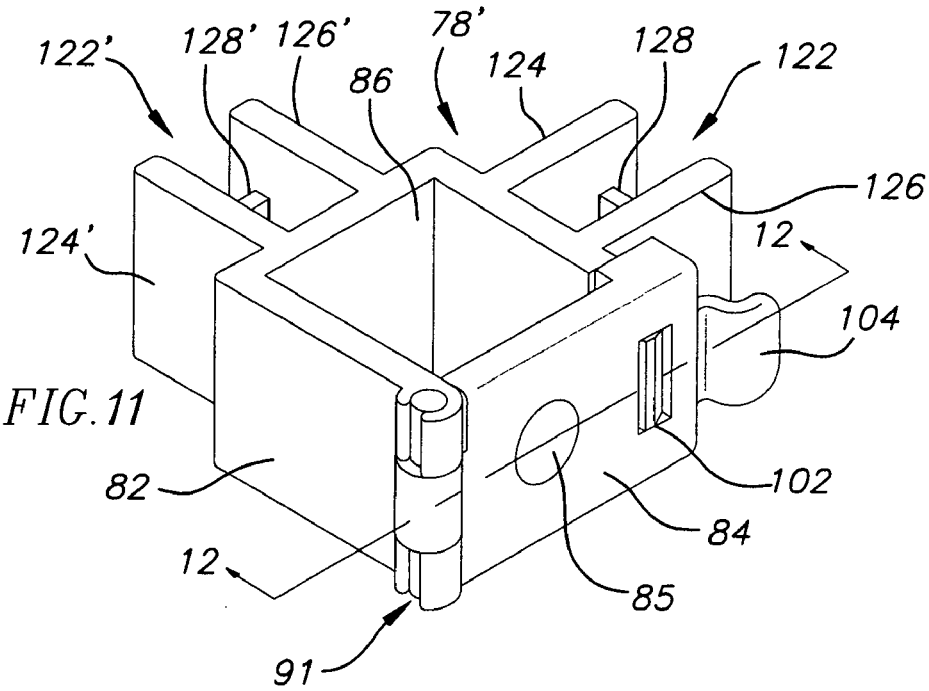
FIG. 11 is a perspective view of a mounting bracket of a side rail assembly according to an exemplary embodiment of the present invention.
Figure 12:
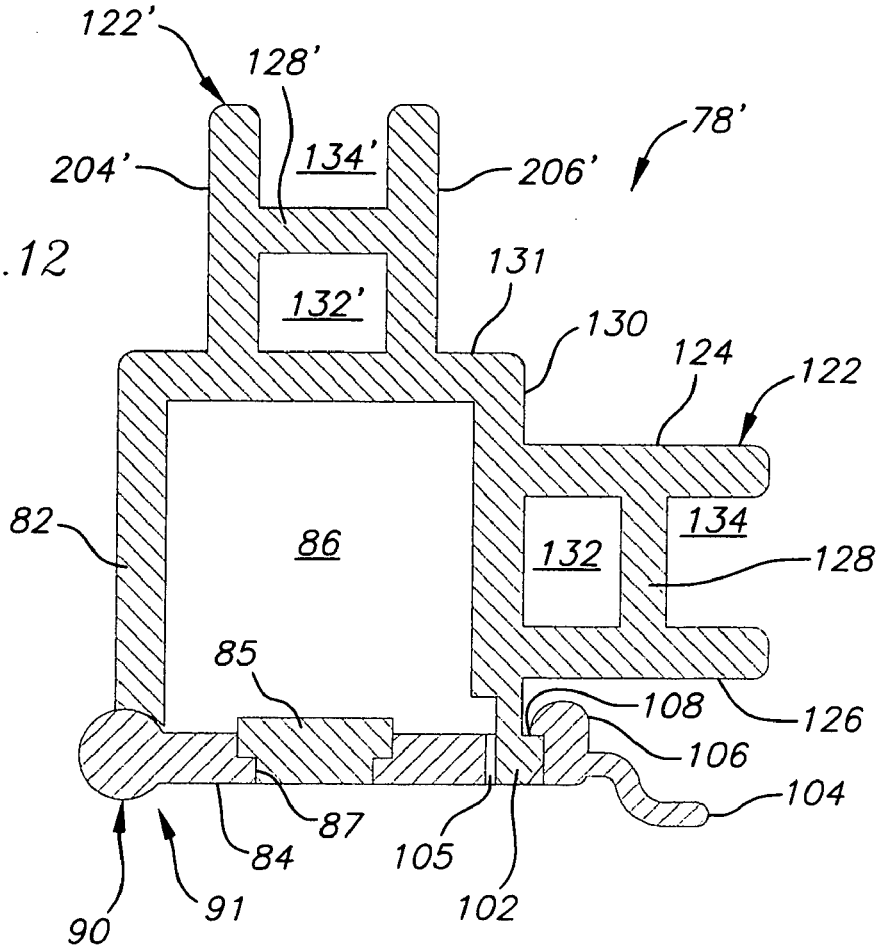
FIG. 12 is a cross-sectional view of the mounting bracket of FIG. 11 taken along line 12—12 of FIG. 11.

FIGS. 11–12 show a mounting bracket 78' having substantially the same structure as that described above for the mounting bracket 78 of FIGS. 5–8, with the addition of a second side rail connector 122' offset approximately ninety degrees from the side rail connector 122. In other embodiments, the side rail connector 122 and the second side rail connector 122' are offset by any other offset angle depending on the arrangement of the uprights 14 to which the mounting bracket 78' is attached.

The second side rail connector 122' extends from a second sidewall 131 of the body 82, and includes two walls 124' and 126', a hook opening 132' and an open end 134' having a substantially similar structure as the two walls 124 and 126, the hook opening 132 and the open end 134 as described above. The mounting bracket 78' allows two side rails 80 to be mounted thereto and offset by ninety degrees with respect to each other, by connecting one side rail 80 to the side rail connector 122 and a second side rail 80 to the second side rail connector 122'.

Figure 13:
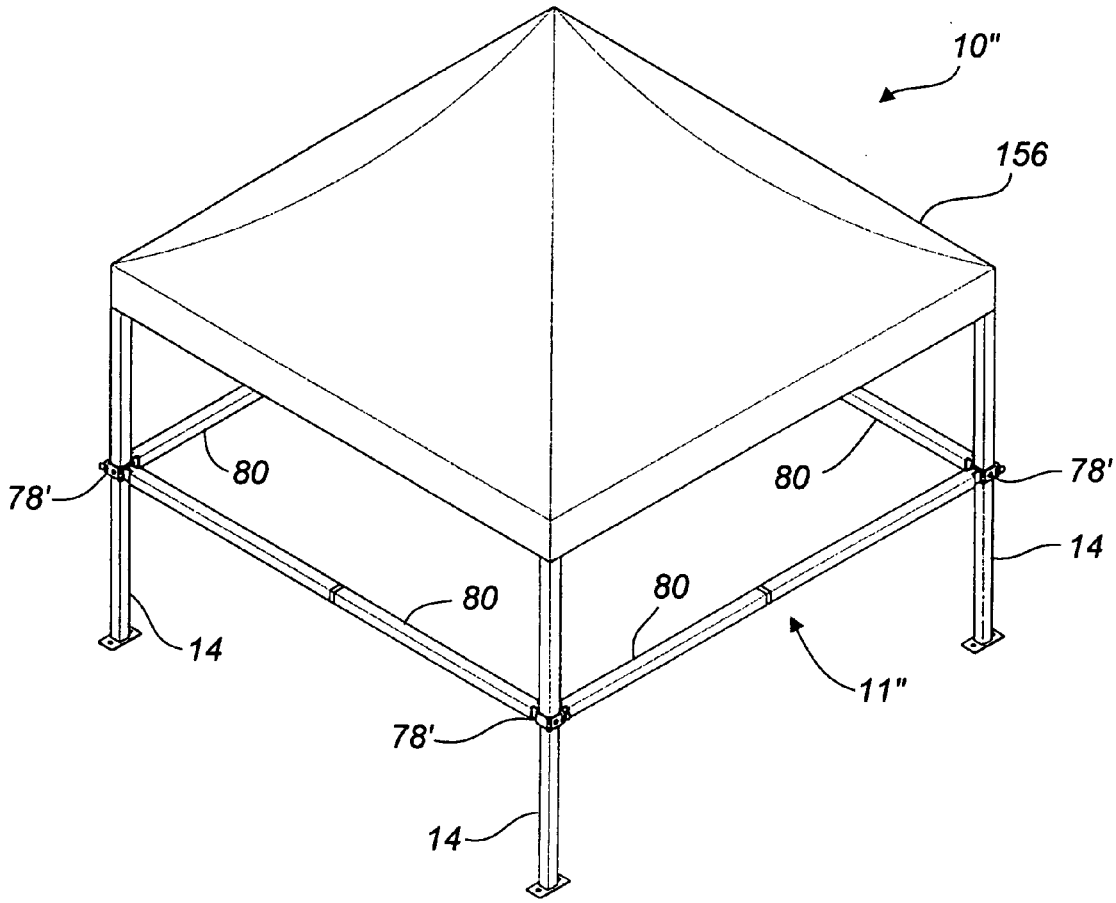
FIG. 13 is a perspective view of a side rail assembly according to another exemplary embodiment of the present invention attached to a collapsible canopy frame.

FIG. 13 shows a side rail assembly 11" attached to a collapsible canopy frame 10" having the cover 156. The side rail assembly 11" includes the side rail 80 and two mounting brackets 78'. To secure the side rail assembly 11" to the collapsible canopy frame 10", the mounting bracket 78' is attached to a corresponding one of each upright 14 at a desired height. Two corresponding side rails 80 are then mounted offset ninety degrees from each other, to a corresponding mounting bracket 78'. The side rails 80 can extend between each adjacent pair of uprights 14 and about an entire periphery of the collapsible canopy frame 10".

Figure 14:
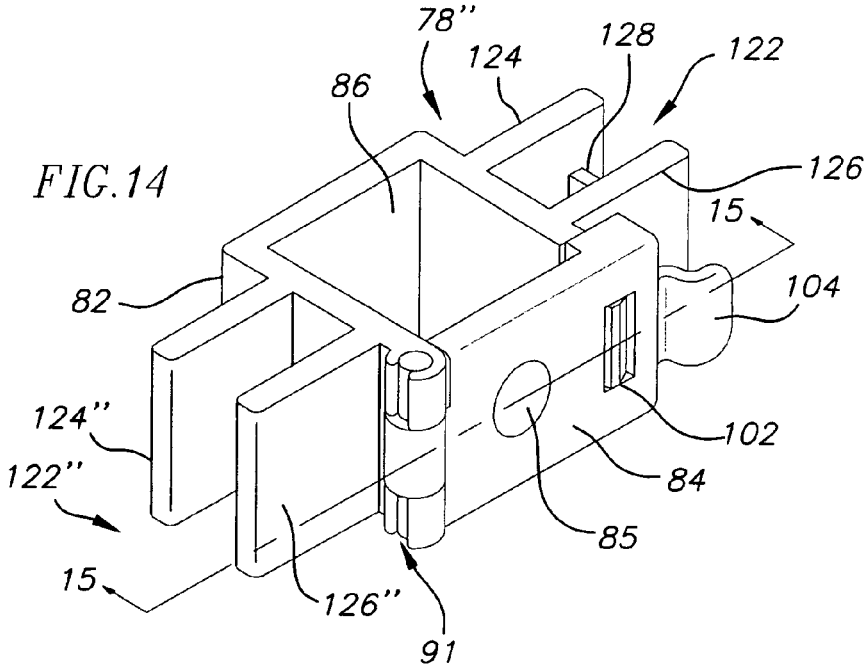
FIG. 14 is a perspective view of a mounting bracket of a side rail assembly according to an exemplary embodiment of the present invention.
Figure 15:
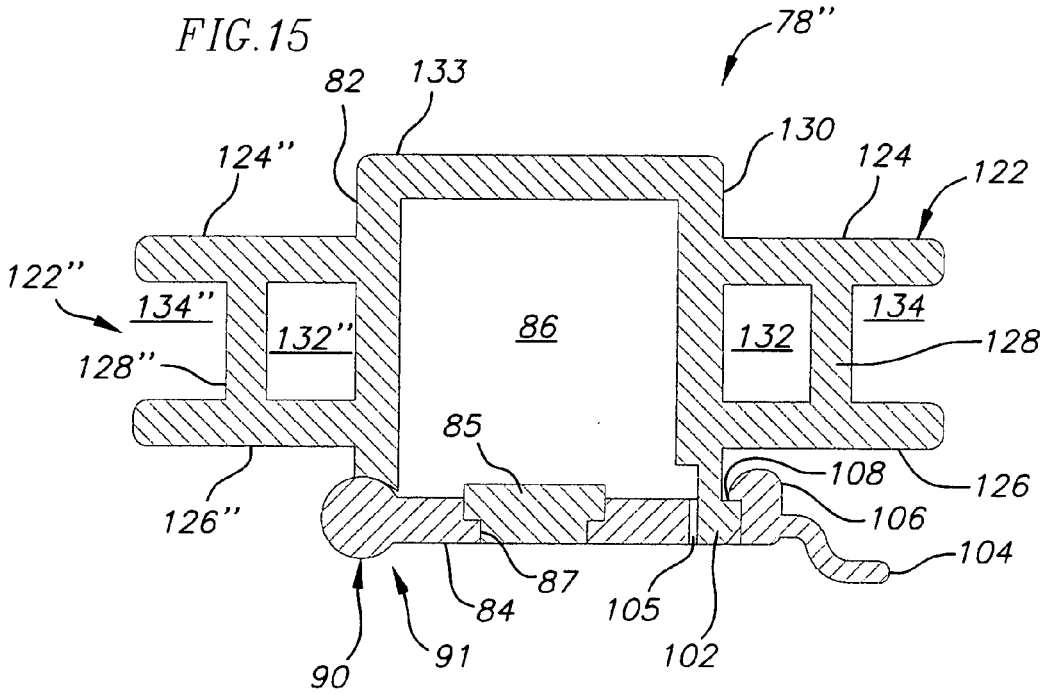
FIG. 15 is a cross-sectional view of the mounting bracket of FIG. 11 taken along line 15—15 of FIG. 14.

FIGS. 14–15 show a mounting bracket 78" having substantially the same structure as that described above for the mounting bracket 78 of FIGS. 5–8, with the addition of a second side rail connector 122" offset approximately one hundred and eighty degrees from the side rail connector 122. In other embodiments, the side rail connector 122 and the second side rail connector 122" are offset by any other offset angle depending on the arrangement of the uprights 14 to which the mounting bracket 78" is attached.

The second side rail connector 122" extends from a third sidewall 133 of the body 82, and includes two walls 124" and 126", a hook opening 132" and an open end 134" having a substantially similar structure as the two walls 124 and 126, the hook opening 132 and the open end 134 as described above. The mounting bracket 78" allows two side rails 80 to be mounted thereto and offset by one hundred and eighty degrees with respect to each other, by connecting one side rail 80 to the side rail connector 122 and a second side rail 80 to the second side rail connector 122".

Figure 16:
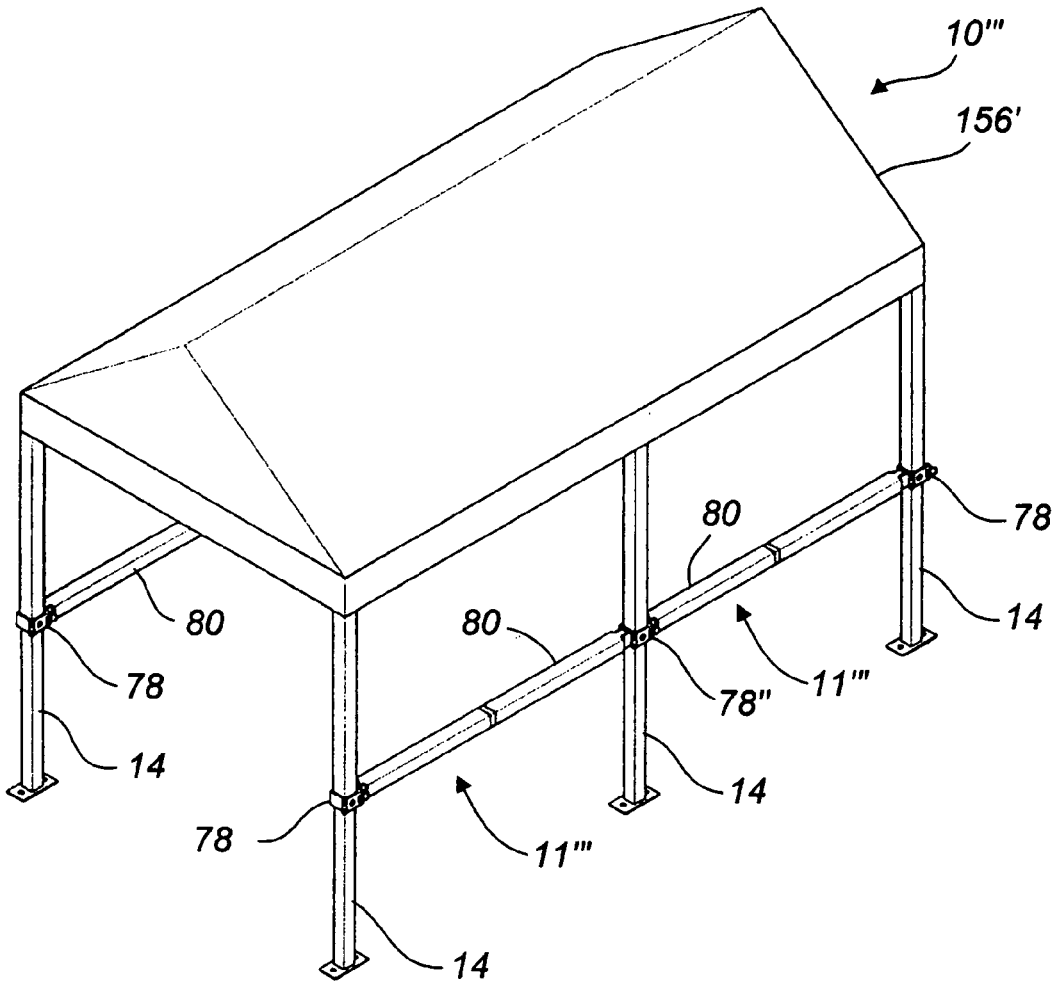
FIG. 16 is a perspective view of a side rail assembly according to another exemplary embodiment of the present invention attached to a collapsible canopy frame.
Figure 5:
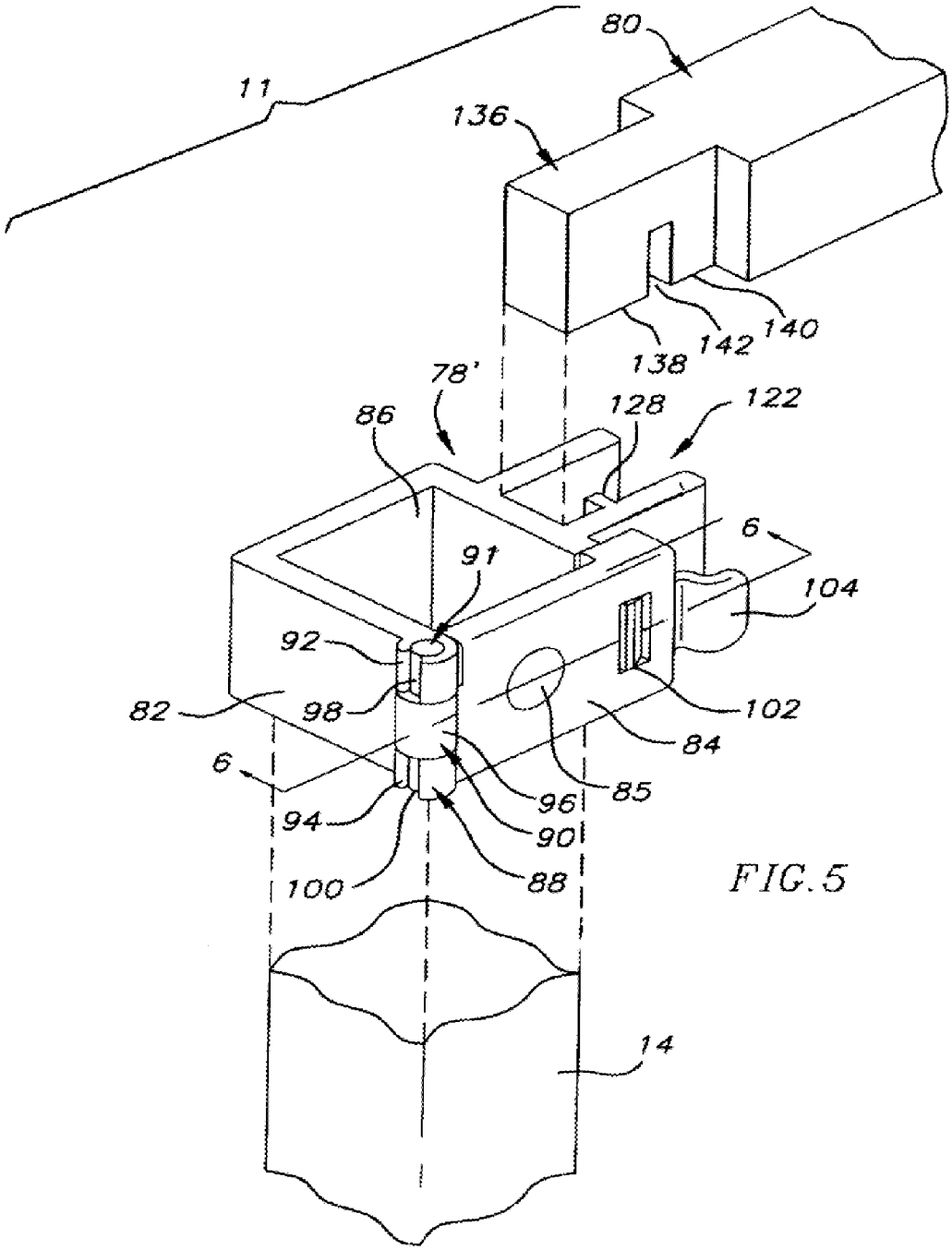
Figure 6A:
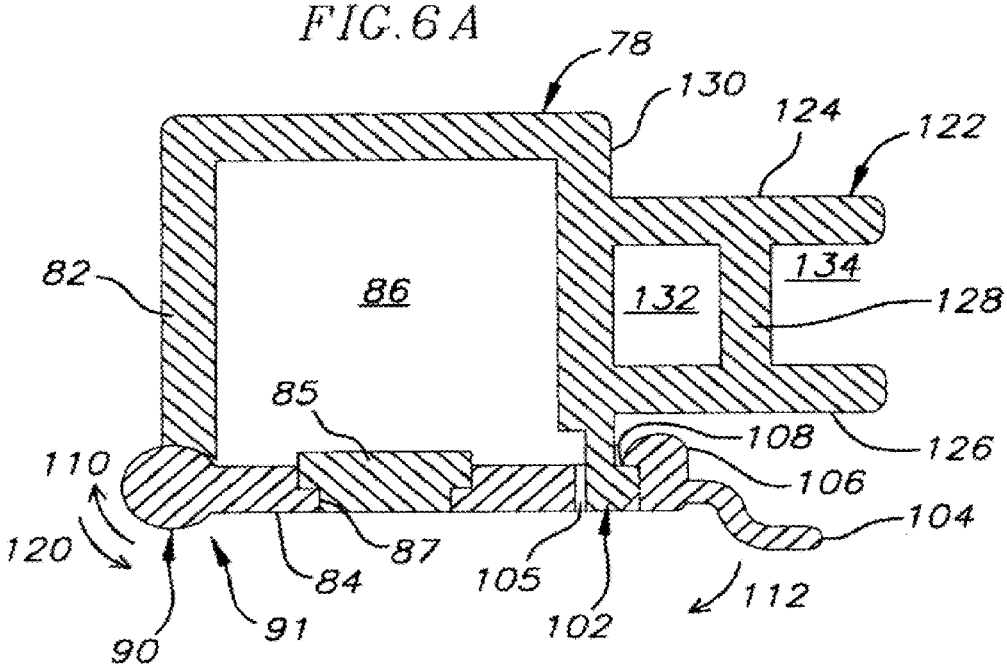
Figure 6B:
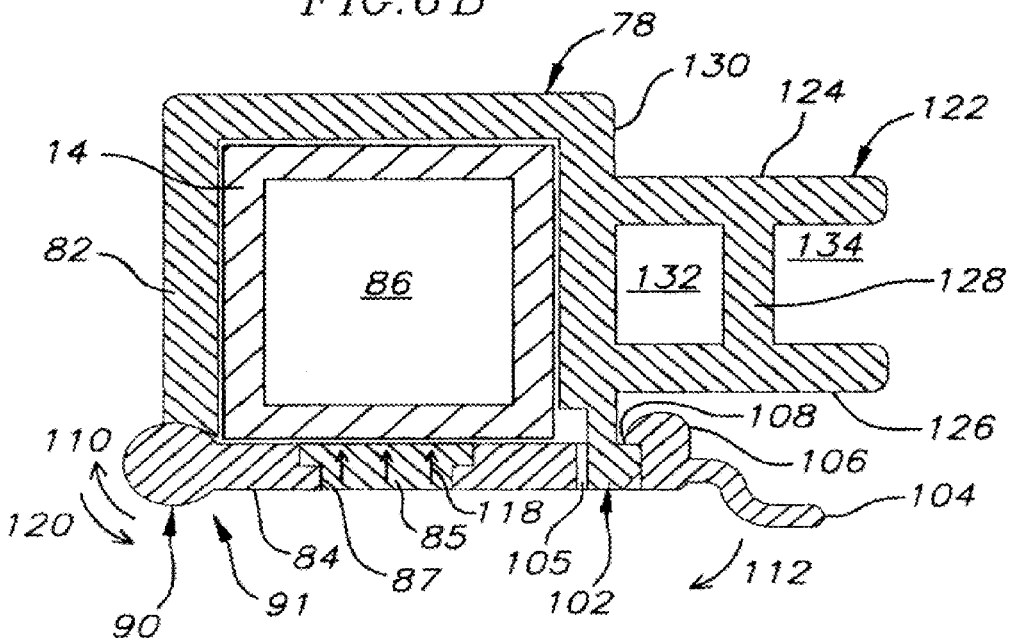
Figure 6C:
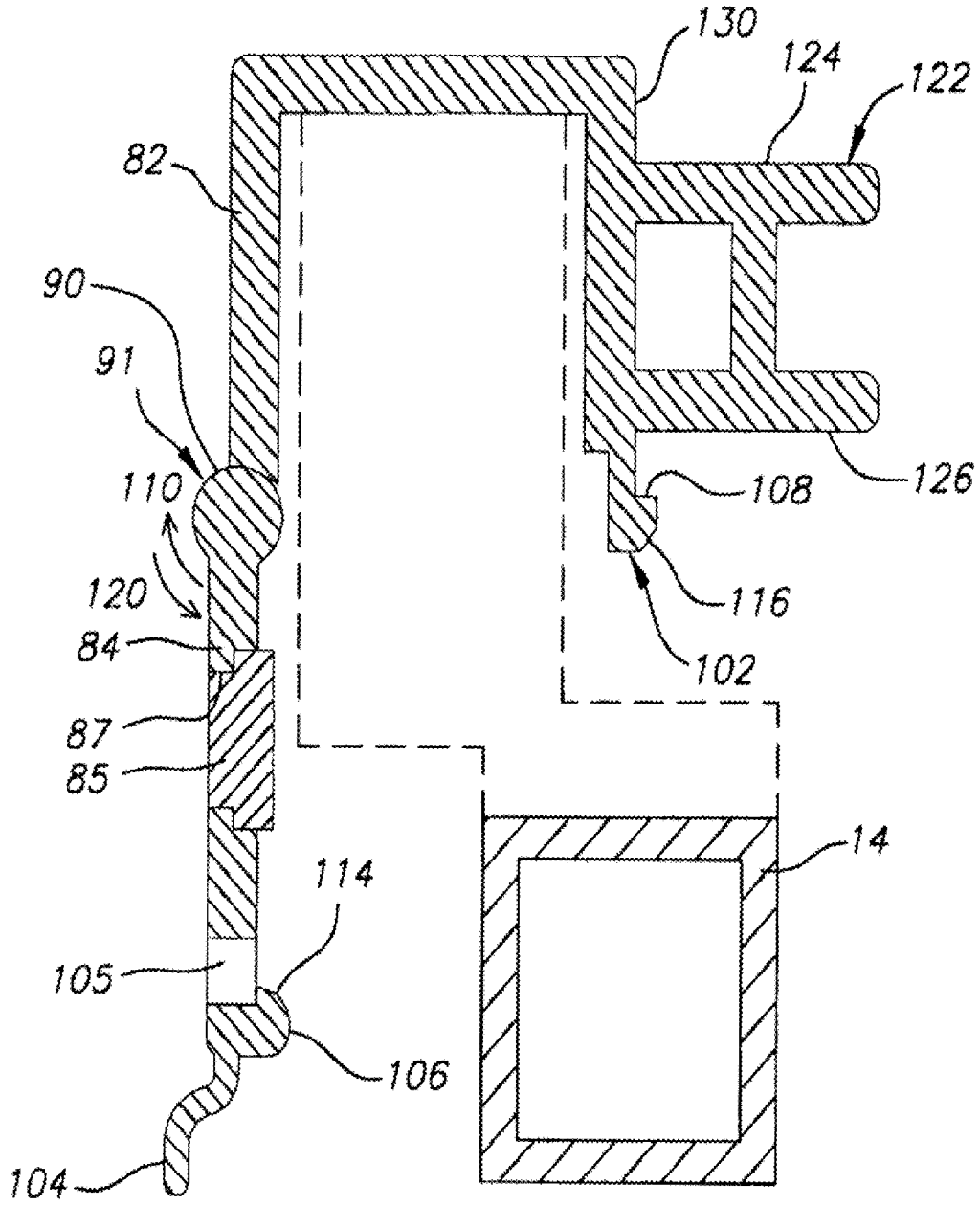
Figure 11:
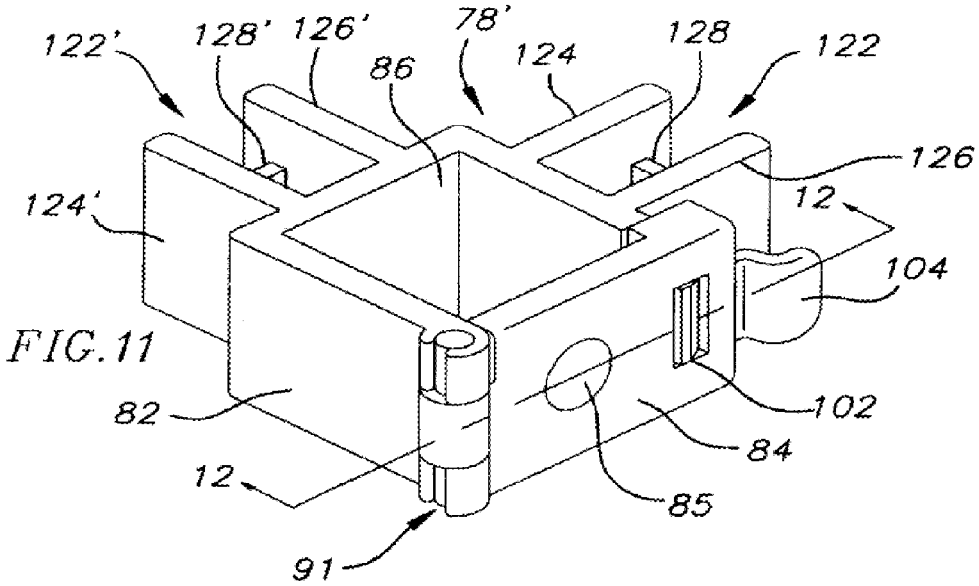
Figure 12:
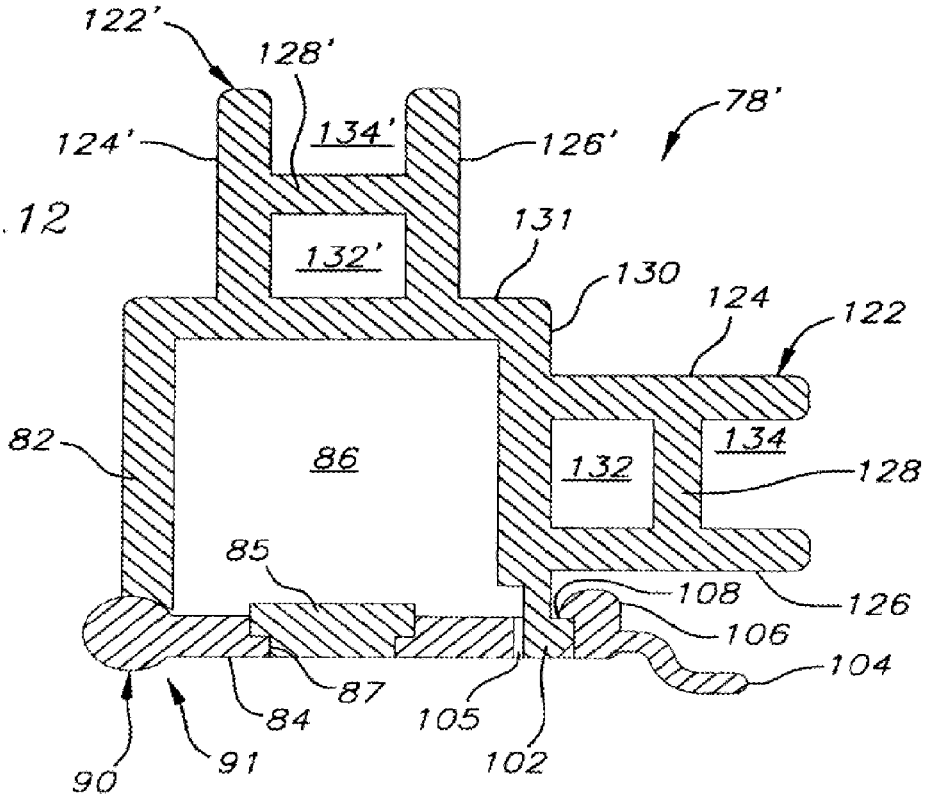

FIG. 16 shows the side rail assembly 11'" attached to a collapsible canopy frame 10'" having the cover 156'. The side rail assembly 11'" includes the side rail 80 and two mounting brackets 78". To secure the side rail assembly 11'" to the collapsible canopy frame 10'", the mounting bracket 78" is attached to each upright 14 in a row of uprights 14 at a desired height. Two corresponding side rails 80 are then mounted offset one hundred and eighty degrees from in other, to a corresponding mounting bracket 78". The mounting bracket 78" allows adjacent collapsible canopy frame to be connected laterally connected through the side rails 80.

Although the above description describes the side rail assembly 11, 11', 11" or 11'" as being attached to the collapsible canopy frame 10, 10', 10" and or 10'", the present invention also contemplates the side rail assembly 11, 11', 11" or 11'" being attached to any other suitable collapsible canopy frame 10 having a fixed-length or telescoping uprights. For example, a collapsible canopy frame having telescoping uprights is shown and described in U.S. patent application Ser. No. 10/728,154, entitled "Collapsible Canopy Frame and Locking Pin Assembly for the Same" filed on Dec. 4, 2003, which is herein incorporated by reference. In addition, the present invention also contemplates the side rail assembly 11, 11', 11" or 11'" being attached to any other suitable non-collapsible canopy frame as well.

It will be appreciated by those of ordinary skill in the art that the invention can be embodied in other specific forms without departing from the spirit or essential character thereof. The present invention is therefore considered in all respects to be illustrative and not restrictive. The scope of the invention is indicated by the appended claims, and all changes that come within the meaning and range of equivalents thereof are intended to be embraced therein.

I claim:

1. A side rail assembly for a canopy having a plurality of uprights, the side rail assembly comprising:

a side rail having a first end and a second end;

a hook attached to the first end of the side rail; and a mounting bracket mounted on a corresponding one of the uprights, wherein the mounting bracket comprises a first side rail connector having a post, and wherein the hook engages the post to secure the side rail to the mounting bracket, wherein the mounting bracket comprises a body and a cover pivotally connected to the body, wherein the body and the cover together define an opening that receives said corresponding one of the uprights, wherein the cover pivots between an open position and a closed position, such that in the open position the mounting bracket receives into the opening said corresponding one of the uprights and in the closed position the mounting bracket is frictionally secured to a side surface of said corresponding one of the uprights, and wherein the cover comprises a resilient compression element that extends into the opening to press against said side surface of said corresponding one of the uprights when the cover is in the closed position.

2. The side rail assembly of claim 1, wherein the cover comprises a locking member that lockingly engages a portion of the body to lockingly connect the cover to the body when the cover is in the closed position.

3. The side rail assembly of claim 1, wherein the cover comprises a detent that lockingly engages a protrusion of the body to lockingly connect the cover to the body when the cover is in the closed position.

4. The side rail assembly of claim 3, wherein the cover has an opening through which the protrusion extends when the cover is in the closed position.

5. The side rail assembly of claim 1, wherein the first side rail connector extends from a first side wall of the body, and wherein the post and the first side wall of the body together define a hook opening that receives a first arm of the hook when the hook is engaged with the post.

6. The side rail assembly of claim 1, wherein the hook comprises a first arm and a second arm that together define a recess in the hook, such that the recess in the hook receives the post when the hook is engaged with the post.

7. The side rail assembly of claim 6, wherein the mounting bracket comprises a second side rail connector having a post, wherein a hook on an end of a second side rail engages the post of the second side rail connector, and wherein the hook of the second side rail comprises a first arm and a second arm that together define a recess in the hook of the second side rail, such that the recess in the hook of the second side rail receives the post of the second side rail connector when the hook of the second side rail is engaged with the post of the second side rail connector.

8. The side rail assembly of claim 1, wherein the hook comprises a first arm and a second arm that together define a recess in the hook, such that when the hook receives the post the recess in the hook receives post and the first and second arms are disposed in surrounding relation to the post.

9. The side rail assembly of claim 1, wherein the mounting bracket comprises a second side rail connector having a post, wherein a hook on an end of a second side rail engages the post of the second side rail connector to secure the second side rail to the mounting bracket.

10. The side rail assembly of claim 9, wherein the first and second side rail connectors are offset from each other by an offset angle such that the side rail and the second side rail are offset from each other by the offset angle when the side rail and the second side rail are engaged to the first and second side rail connectors, respectively.

11. The side rail assembly of claim 10, wherein the offset angle is approximately ninety degrees.

12. The side rail assembly of claim 10, wherein the offset angle is approximately one hundred and eighty degrees.

13. The side rail assembly of claim 1, wherein the mounting bracket comprises a second side rail connector having a post, wherein a hook on an end of a second side rail engages the post of the second side rail connector to secure the second side rail to the mounting bracket, and wherein the second side rail connector extends from a second side wall of the body, such that the post of the second side rail connector and the second side wall of the body together define a hook opening that receives a first arm of the hook of the second side rail when the hook of the second side rail is engaged with the post.

14. The side rail assembly of claim 1, wherein the cover has an opening defined therein, and wherein the resilient compression element is mounted in the opening of the cover.

15. A side rail assembly for a canopy having a plurality of uprights, the side rail assembly comprising:

a side rail having a first end and a second end;

a hook attached to the first end of the side rail; and a mounting bracket mounted on a corresponding one of the uprights, wherein the mounting bracket comprises:

a body;

a cover pivotally connected to the body, wherein the body and the cover together define an opening that receives said corresponding one of the uprights, wherein the cover pivots between an open position and a closed position, such that in the open position the mounting bracket is insertable around said corresponding one of the uprights and in the closed position the mounting bracket is frictionally secured to a side surface of said corresponding one of the uprights; and a first side rail connector having a post, wherein the hook engages the post to secure the side rail to the mounting bracket, wherein the cover comprises a resilient compression element that extends into the opening to press against said side surface of said corresponding one of the uprights when the cover is in the closed position.

16. The side rail assembly of claim 15, wherein the cover comprises a locking member that lockingly engages a portion of the body to lockingly connect the cover to the body when the cover is in the closed position.

17. The side rail assembly of claim 15, wherein the cover comprises a detent that lockingly engages a protrusion of the body to lockingly connect the cover to the body when the cover is in the closed position.

18. The side rail assembly of claim 17, wherein the cover has an opening through which the protrusion extends when the cover is in the closed position.

19. The side rail assembly of claim 15, wherein the first side rail connector extends from a first side wall of the body, and wherein the post and the first side wall of the body together define a hook opening that receives a first arm of the hook when the hook is engaged with the post.

20. The side rail assembly of claim 15, wherein the hook comprises a first arm and a second arm that together define a recess in the hook, such that the recess in the hook receives the post when the hook is engaged with the post.

21. The side rail assembly of claim 15, wherein the hook comprises a first arm and a second arm that together define a recess in the hook, such that when the hook receives the post the recess in the hook receives post and the first and second arms are disposed in surrounding relation to the post.

22. The side rail assembly of claim 15, wherein the mounting bracket comprises a second side rail connector having a post, wherein a hook on an end of a second side rail engages the post of the second side rail connector to secure the second side rail to the mounting bracket.

23. The side rail assembly of claim 22, wherein the first and second side rail connectors are offset from each other by an offset angle such that the side rail and the second side rail are offset from each other by the offset angle when the side rail and the second side rail are engaged to the first and second side rail connectors, respectively.

24. The side rail assembly of claim 23, wherein the offset angle is ninety degrees.

25. The side rail assembly of claim 23, wherein the offset angle is one hundred and eighty degrees.

26. The side rail assembly of claim 15, wherein the mounting bracket comprises a second side rail connector having a post, wherein a hook on an end of a second side rail engages the post of the second side rail connector to secure the second side rail to the mounting bracket, and wherein the second side rail connector extends from a second side wall of the body, such that the post of the second side rail connector and the second side wall of the body together define a hook opening that receives a first arm of the hook of the second side rail when the hook of the second side rail is engaged with the post.

27. The side rail assembly of claim 15, wherein the mounting bracket comprises a second side rail connector having a post, wherein a hook on an end of a second side rail engages the post of the second side rail connector to secure the second side rail to the mounting bracket, and wherein the hook of the second side rail comprises a first arm and a second arm that together define a recess in the hook of the second side rail, such that the recess in the hook of the second side rail receives the post of the second side rail connector when the hook of the second side rail is engaged with the post of the second side rail connector.

28. The side rail assembly of claim 15, wherein the side rail comprises a plurality of side rail sections that are connected together.

29. The side rail assembly of claim 28, wherein at least two adjacent said side rail sections are coupled together via a support connector.

30. The side rail assembly of claim 15, wherein the cover has an opening defined therein, and wherein the resilient compression element is mounted in the opening of the cover.

31. A collapsible canopy frame comprising:

telescoping uprights;

a set of edge scissor assemblies that are pivotally coupled between adjacent ones of the telescoping uprights, each said set of edge scissor assemblies having ribs that rotate relative to each other;

a side rail having a first end and a second end;

a hook attached to the first end of the side rail; and a mounting bracket mounted on a corresponding one of the uprights, wherein the mounting bracket comprises a first side rail connector having a post, and wherein the hook engages the post to secure the side rail to the mounting bracket, wherein the mounting bracket has a resilient member on a surface abutting the corresponding upright, such that the mounting bracket is frictionally secured to a side surface of the corresponding upright.

32. The collapsible canopy frame of claim 31, wherein the mounting bracket has an opening defined in the surface abutting the corresponding upright, and wherein the resilient member is mounted in the opening defined in the surface.

* * * * *

UNITED STATES PATENT AND TRADEMARK OFFICE

CERTIFICATE OF CORRECTION

PATENT NO. : 7,240,685 B2
APPLICATION NO. :10/758762
DATED : July 10, 2007
INVENTOR(S) : Seo It is certified that error appears in the above-identified patent and that said Letters Patent is hereby corrected as shown below:

In the Drawings

| | |
|---|---|
| FIG. 5, Sheet 4 of 12 | Delete Drawing Sheet 4 and substitute therefore the Drawing Sheet, consisting of Fig. 5, as shown on the attached page |
| FIG. 6A, Sheet 5 of 12 | Delete Drawing Sheet 5 and substitute therefore the Drawing Sheet, consisting of Figs. 6A & 6B, as shown on the attached page |
| FIG. 6C, Sheet 6 of 12 | Delete Drawing Sheet 6 and substitute therefore the Drawing Sheet, consisting of Fig. 6C, as shown on the attached page |
| FIG. 12, Sheet 9 of 12 | Delete Drawing Sheet 9 and substitute therefore the Drawing Sheet, consisting of Figs. 11 & 12, as shown on the attached page |

Signed and Sealed this

Second Day of December, 2008

JON W. DUDAS
*Director of the United States Patent and Trademark Office*